United States Patent [19]

Hackney

[11] 4,260,312

[45] Apr. 7, 1981

[54] APPARATUS FOR TRANSFERRING TOXIC AND RADIOACTIVE MATERIALS

[75] Inventor: Stanley Hackney, Appleton, England

[73] Assignee: United Kingdom Atomic Energy Authority, London, England

[21] Appl. No.: 74,478

[22] Filed: Sep. 11, 1979

[30] Foreign Application Priority Data

Sep. 27, 1978 [GB] United Kingdom ..... 38429/78

[51] Int. Cl.[3] ..... G21F 7/00

[52] U.S. Cl. ..... 414/292; 250/506; 422/903

[58] Field of Search ..... 252/301.1 W; 250/506; 176/37; 414/292, 146; 422/903

[56] References Cited

U.S. PATENT DOCUMENTS

| | | | |
|---|---|---|---|
| 3,489,298 | 1/1970 | Samsel et al. | 414/292 |
| 4,016,096 | 4/1977 | Meyer | 252/301.1 W |
| 4,055,508 | 10/1977 | Yoli et al. | 252/301.1 W |

FOREIGN PATENT DOCUMENTS

| | | | |
|---|---|---|---|
| 938311 | 10/1963 | United Kingdom | 414/292 |
| 995332 | 6/1965 | United Kingdom | 414/292 |

*Primary Examiner*—Deborah L. Kyle

*Attorney, Agent, or Firm*—Larson, Taylor and Hinds

[57] ABSTRACT

Apparatus for transfer of toxic and radioactive materials between a work enclosure and a container for storing and transporting the materials. Materials are moved through a "double-cover" in which a port in the enclosure is closed by a first cover and the container is closed by a second cover. During transfer, the covers are connected together and the space between the covers is swept by an air stream to prevent ingress and deposition of toxic or radioactive material on the surfaces thereof which are exposed to the environment on separation of the covers.

5 Claims, 9 Drawing Figures

9
5
8
4
13
7
24
1
14
6
11
10
43
44
3
8
9
56
51
52
53
21
17
50
16
54
55

APPARATUS FOR TRANSFERRING TOXIC AND RADIOACTIVE MATERIALS

BACKGROUND OF THE INVENTION

This invention relates to the transfer of toxic or radioactive materials. In plants utilising such materials it is known to perform any work on the materials inside enclosures which are isolated from the environment. An example of such an enclosure is a glove box in which all operations are performed by an operator outside the glove box using gloves attached to appropriate positions in the walls of the box. The use of these enclosures is intended to ensure that none of the toxic or radioactive material is dispersed into the environment around the enclosure. It is particularly important that no dispersal occurs during the transfer of materials into and out of the enclosure.

Several methods of obviating the problems of dispersal during the transfer of materials into and out of enclosures have been proposed in which the so-called "double-cover" principle is employed. In these systems the material is transferred into or out of a container through a port in the wall of the enclosure, the container being attached to the wall of the enclosure around the port which is normally closed by a port cover. In the "double-cover" principle any part of the port or container which is exposed to the environment when the container is separated from the port is protected from exposure to the atmosphere within the enclosure. In one known method the port cover and the container cover are engaged as the container is fitted around the port so that their outer surfaces face each other and a seal is provided to prevent contamination of the outer surfaces when the interengaged covers are inside the enclosure. The seals used are complex in shape and expensive to produce and may produce a ring of contamination on their sealing surface which may be dispersed when the container is removed from the port.

SUMMARY OF THE INVENTION

According to the present invention there are provided a method and apparatus for transferring toxic or radioactive materials into or out of an enclosure in which a container is fitted around a port in a wall of the enclosure, the container cover and the cover for the interior of the port are interengaged and withdrawn into the enclosure to enable material to pass between the container and the enclosure through the port and a stream of gas at a pressure above the pressure within the enclosure is passed into the gap between the interengaged covers to prevent ingress and deposition of material on those surfaces of the cover for the interior of the port and the container cover which are exposed to the environment when the container is remote from the port.

Preferably a stream of gas is also passed into a gap between the container and the wall of the enclosure surrounding the port to prevent deposition of material in or around said gap.

DESCRIPTION OF THE DRAWINGS

The invention will be illustrated by the following description of two embodiments of posting port and container for transferring toxic or radioactive materials into or out of an enclosure. The description is given by way of example only and has reference to the accompanying drawings in which.

DESCRIPTION OF THE PREFERRED EMBODIMENTS

Figure 1:
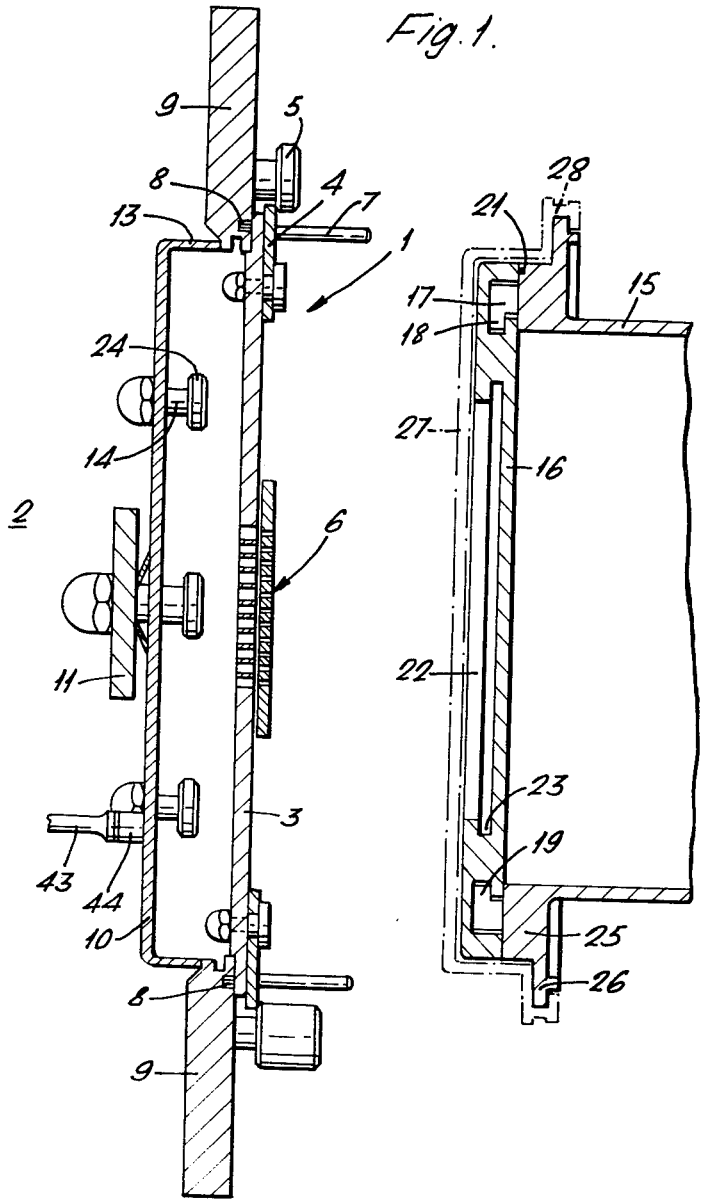
FIG. 1 is a cross-sectional view of a posting port and container when the posting port and container are separated.
Figure 3:
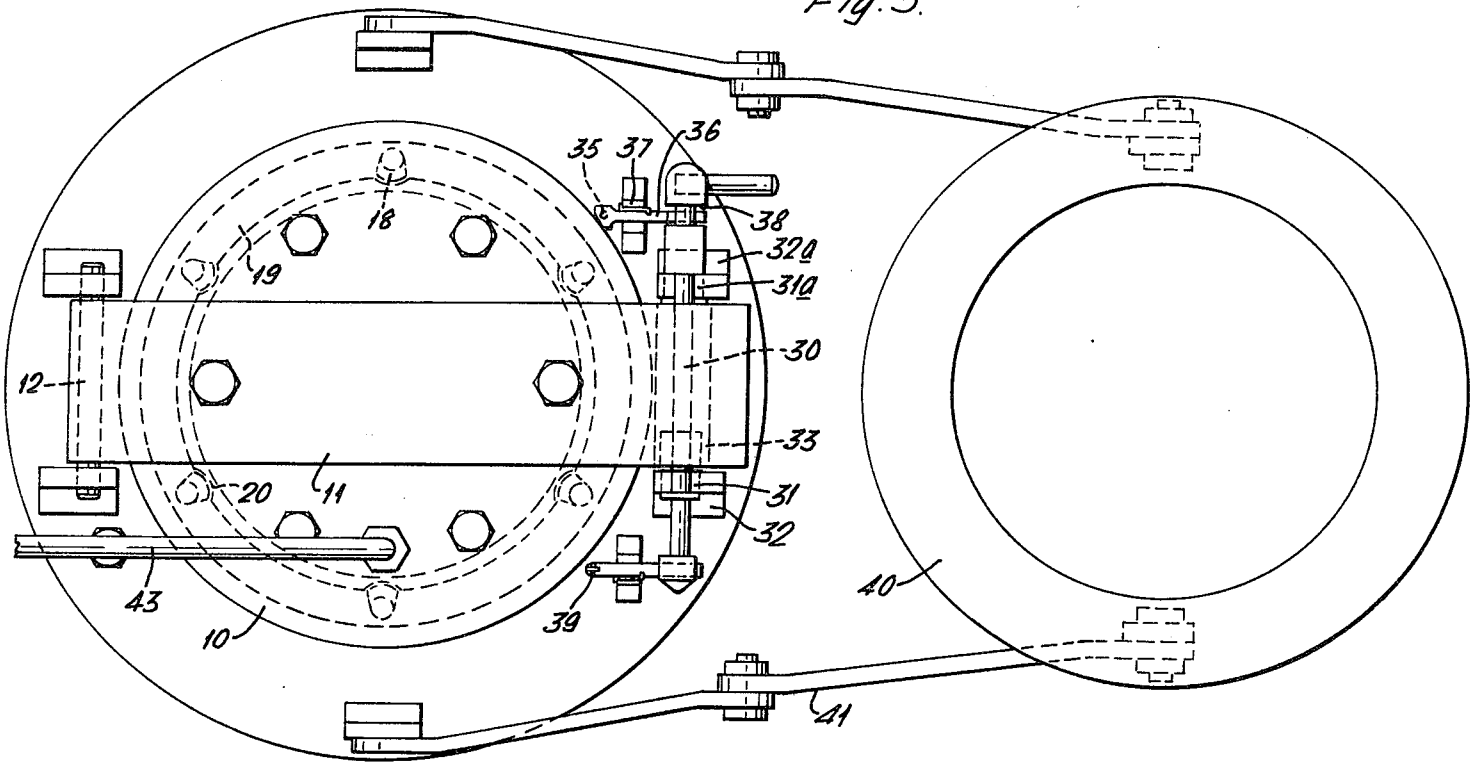
FIG. 3 is a view taken in the direction of the arrow A in FIG. 2.

Referring first to FIG. 1 there is illustrated a port 1 leading into an enclosure 2. On the exterior of the port is a port cover 3 which is hinged to the wall of the enclosure and which has an outwardly directed flange 4 which is movable relative to the port cover and is adapted to be located under buttons 5 around the port 1. The flange is provided with cut-away portions (not shown) equal in number with the buttons 5 and so positioned that as the flange is rotated, the cut-away portions can be aligned with the buttons to enable the port cover 3 to be removed. The port cover 3 is provided with a filter 6 and studs 7 to assist in rotating the flange. A seal 8 prevents the passage of material between the port cover 3 and the wall 9 surrounding the port 1. Inside the enclosure 2 the port is covered by an inner cover 10 which is supported on a bar 11 which is connected to the wall 9 by a hinge pin 12 (FIG. 3). The inner cover 10 has an upstanding wall 13 around its periphery extending towards the port 1 and the edge of the wall 13 remote from the cover 10 contacts the wall 9 around the port. Six buttons 14 extend from the inner cover towards the port. p FIG. 1 also illustrates a container 15 which fits onto the port 1 and enables material to be passed into or out of the enclosure 2. The container has a cover 16 which is located on the container 15 by means of projections 17 on a flange 25 extending around the opening of the container 15. The projections 17 each have a portion 18 (as can be seen from the dotted lines in FIG. 3) which is directed towards the centre of the container cover 16. The projections 17 are received in an undercut groove 19 around the container cover. Cutaway portions 20 in the side of the groove enable the cover 16 and container to be separated by relative rotation of the cover and container to align the projections 17 with the cut-away portions 20. At all other positions the portion 18 extends into the undercut groove 19 and locks the cover and container together. A seal 21 is located between the flange 25 around the container and the cover. The cover 16 has on its surface remote from the container 15 a central depression 22 which has an annular groove 23 around the inner end of its wall. The groove 23 is of such a size that it can receive the enlarged heads 24 of the buttons 14 of the inner cover 10. Cut-away portions of the wall of the groove 23 (not shown) enable the buttons 14 to enter the groove 23 when the inner cover 10 and container cover 16 are in the appropriate relative orientation. Relative rotation of the inner and container covers causes the heads 24 of the buttons to be held by the groove 23 to interlock the cover together. The flange 25 has an outwardly directed portion 26 which has the same shape as the flange 4 on the port cover 3 so that the portion 26 may be engaged with the buttons 5 around the port 1 to position the container round the port. A transport cover 27 (shown by chain dotted lines) is used to protect the outer surface of the container cover 16 when the container is being transported to or away from the port. The transport cover has hook shaped projections 28 which engage with the outwardly directed portion 26 of the flange 25 to locate the transport cover in place on the container.

Figure 7:
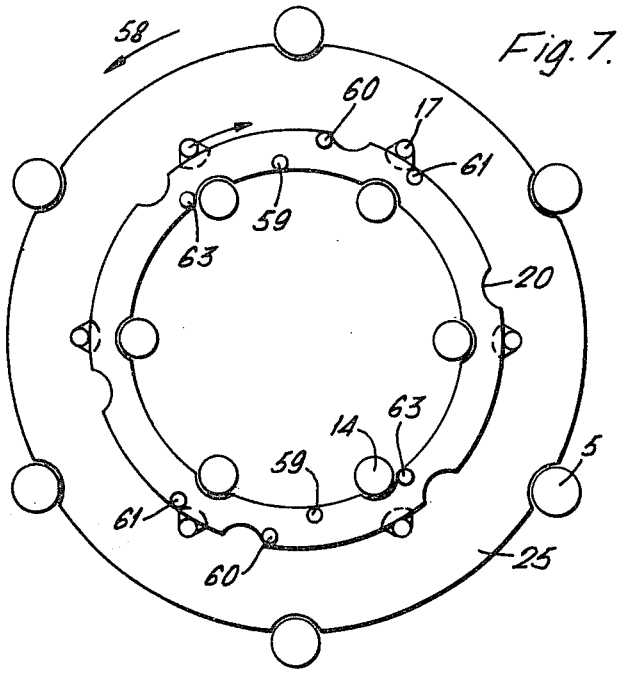
FIGS. 7 and 8 are schematic diagrams illustrating the operating sequence.
Figure 8:
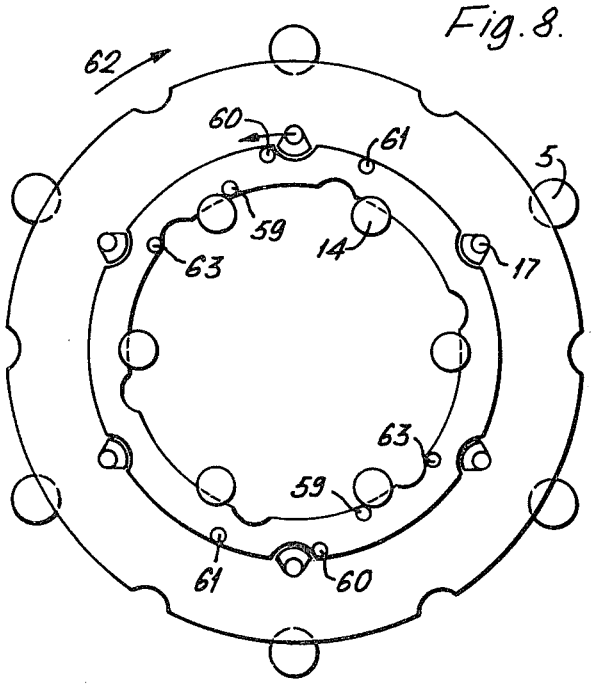

When it is desired to attach the container 15 to the port to enable material to be placed into or be removed from the enclosure the port cover 3 and the transport cover 27 are removed and the container presented to the port so that the cut-away portions in the outwardly directed portion 26 of the flange 25 on the container are aligned with the buttons 5 around the port and the buttons 14 of the inner cover 10 are aligned with the cut-away portions of the wall of the groove 23. This is illustrated in FIG. 7. The container is then pushed towards the port and rotated in the direction of the arrow 58 of FIG. 7 using handles 29 so that the flange 25 is held by the buttons 5 and the button 14 are held in the groove 23. During this rotation the container cover 16 rotates with the container 15. When the container has rotated through 15° the flange 25 will be engaged behind the buttons 5 and the buttons 14 will have entered the groove 23. The buttons 14 then contact pins 59 located in the groove 23 which prevent further rotation of the container cover 16 with respect to the inner cover 10. Rotation of the container through a further 15° causes the container to rotate relative to the container cover to bring the projections 17 into alignment with the cut-away portions 20 so that the container cover is not engaged with the container. This is the position illustrated in FIGS. 2 and 8 in which two of the projections 17 are shown contacting pins 60 in the groove 19 to prevent rotation of the container past the position shown in FIG. 8. Further pins 61 are provided in the groove 19 so that during the reversal of the above procedure to release the container the projections 17 contact the pins 61 after an initial 15° movement in the direction of the arrow 62 of FIG. 8. Further rotation in the direction of the arrow 62 causes the container cover to rotate with the container so bringing the cut-away portions of the wall of the groove 23 into alignment with the buttons 14 on the inner cover. Pins 63 prevent the container cover rotating past this position.

Figure 2:
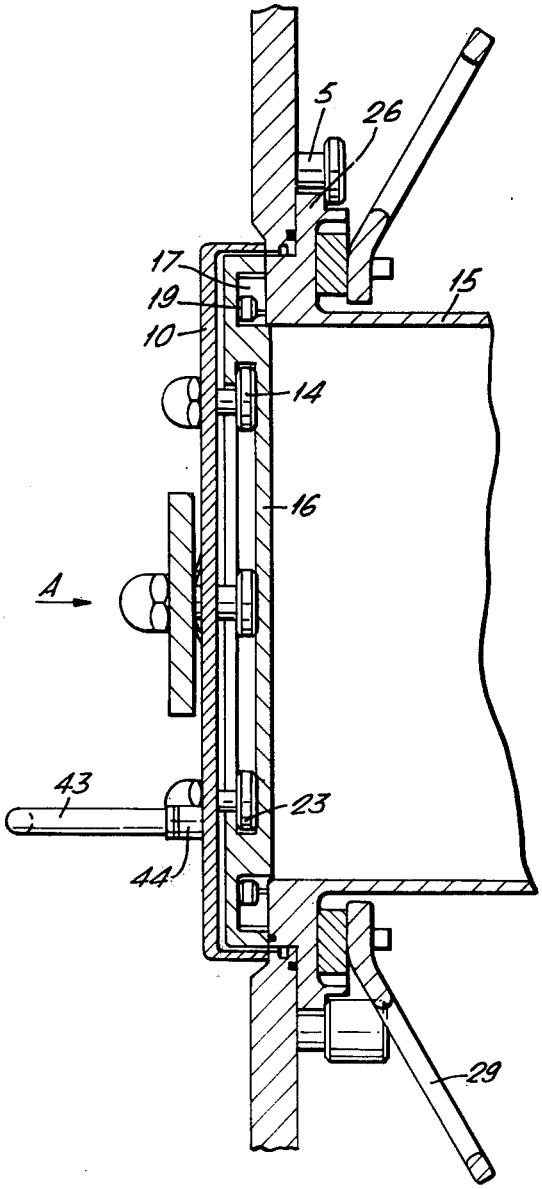
FIG. 2 is a cross-sectional view of the posting port and container of FIG. 1 when the container is engaged around the port.

In the position shown in FIG. 2 the interlocked inner cover and container cover are not engaged with the container. To prevent misuse of the apparatus interlocks are provided to ensure the apparatus is used correctly. These interlocks will now be described with reference to FIG. 3 which is a view of the inner cover viewed from inside the enclosure 2. The bar 11 on which the inner cover 10 is supported is prevented from being hinged to its open position by a pin 30 which passes through the bar 11. An enlarged section 31 of the pin 30 is held in a bracket 32 below the bar when the cover is in its closed position. To enable the cover to be moved to its open position the pin 30 must be raised so that it enters an aperture 33 in the bar. When the enlarged portion 31 is inside the aperture 33 the part of the pin 30 below the enlarged portion 31 which is of smaller diameter than the enlarged portion is able to pass through the opening 34 (FIG. 4) in the bracket 32. Similarly an enlarged portion **31*a* above the bar 11 is raised as the pin 30 is lifted so that it is clear of an upper bracket 32*a* which is similar to the bracket 32. The first interlock against misuse ensures that the inner cover cannot be moved to its open position when there is no container on the outside of the port. A pin 35 connected to a pivotted arm 36 passes through the wall 9 and when a container is in position the pin is urged into the enclosure by the outwardly directed portion 26 of the flange 25 of the container. The arm 26 which is pivotted at 37 is then moved so that its free end is moved out of a groove 38 at the upper end of the pin 30 enabling the pin 30 to be lifted to release the bar 11. The second interlock ensures that the container cannot be removed when the inner cover is in its open position. A second pin 39 passing through the wall 9 is urged to extend through the wall 9 so that it is received in a bore in the outwardly directed portion 26 of the flange 25 of the container when the container is in position. With the pin 39 in position in the bore rotation of the container relative to the wall 9 is prevented. When the pin 30 is in position to lock the inner cover 10 in its closed position an enlarged end portion 60 contacts one end of an arm 61 which is pivotted and carries the pin 39** at its other end so that the arm is moved to retract the pin so that it is released from the bore to enable the container to be rotated and removed.

Figure 4:
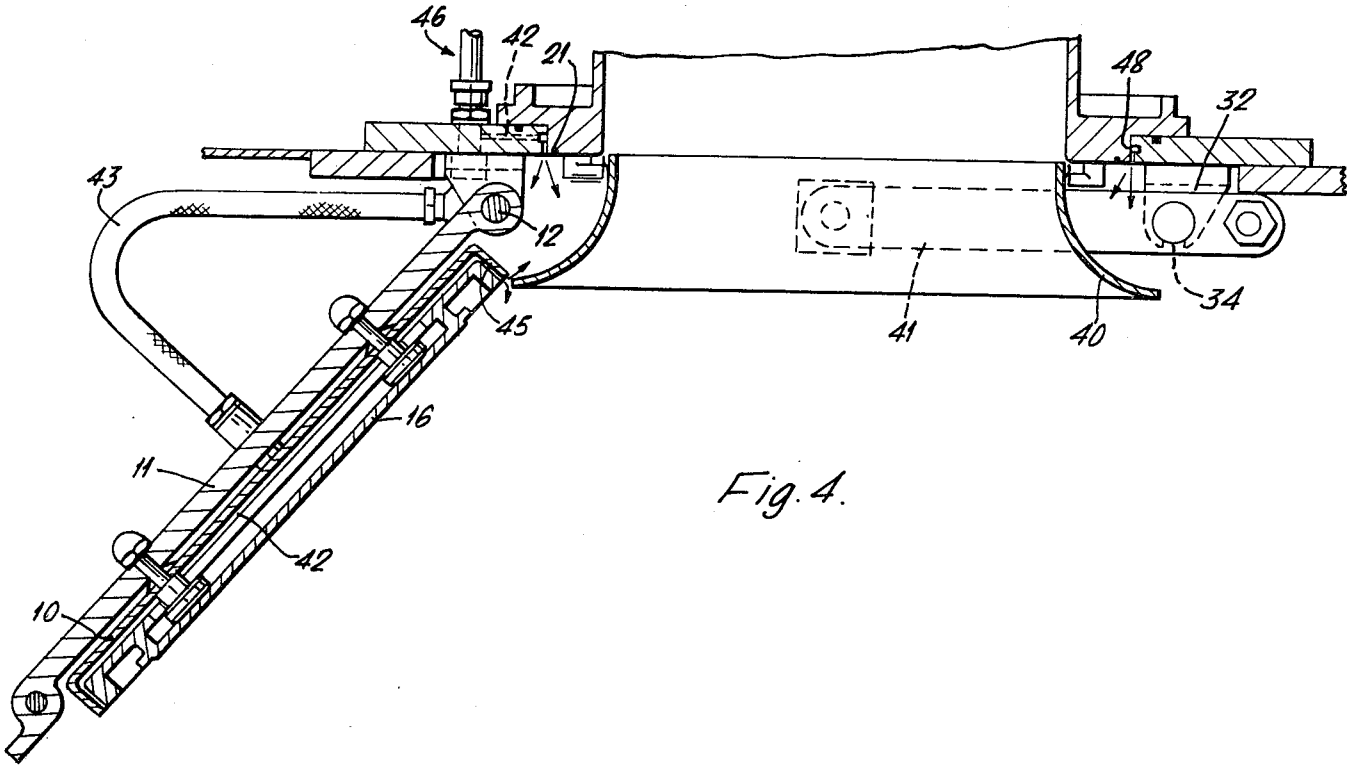
FIG. 4 is a cross-sectional view of the port and container of FIGS. 1 to 3 when the container is in communication with the enclosure.

When a container is in place the pin 30 may be lifted to release the inner cover 10 which may then be hinged on the hinge pin 12 to the position shown in FIG. 4 so that the interior of the enclosure 2 is in communication with the interior of the container through the port 1. To minimise the risk of contamination as material is passed through the port 1 a flared port insert 40 is located in the port 1. The insert 40 is supported on pivotted arms 41 so as to be movable from a storage position as shown in FIG. 3 to an in-use position as shown in FIG. 4.

When the enclosure and container are used with toxic or radioactive materials, it is important that no egress of such materials to the environment around the enclosure takes place. To ensure this a stream of gas is passed over all the surfaces which are exposed to the toxic or radioactive materials and which are exposed to the environment when the container is remote from the enclosure. These surfaces are the surface of the container cover 16 remote from the container, the surface on the inner cover 10 which faces the port 1, the area of the flange 25 of the container 15 adjacent the seal 21 and the inward-facing edge of the wall 9 around the port. The gas stream to prevent contamination entering the space 42 between the container cover 16 and the inner cover 10 is supplied via a flexible pipe 43 and the gas flows from the inlet 44 into the space 42 and is vented into the enclosure 2 through the annular gap 45 between the edge of the container cover 16 and the upstanding wall 13 of the inner cover 10. Gas is supplied to the pipe 43 from an inlet pipe 46. A duct 42 leading from the inlet pipe 46 directs some of the gas to the annular gap 48 between the flange 25 of the container and the inward facing edge of the wall 9 to sweep the gap 48 and the surfaces of the flange 25 adjacent the seal 21 and the wall 9. The gas flow through the gaps 45, 48 must be sufficient to prevent the ingress and deposition of material. In enclosures which operate at subatmospheric pressure the gas stream may be provided by having the inlet pipe 46 open to the atmosphere outside the enclosure so that air is sucked into the enclosure through the gaps 45, 48. Alternatively a source of pressurised gas may be used to feed the inlet pipe 46. Means may be provided to cause the gas stream to flow as a container is fitted around the port.

Figure 9:
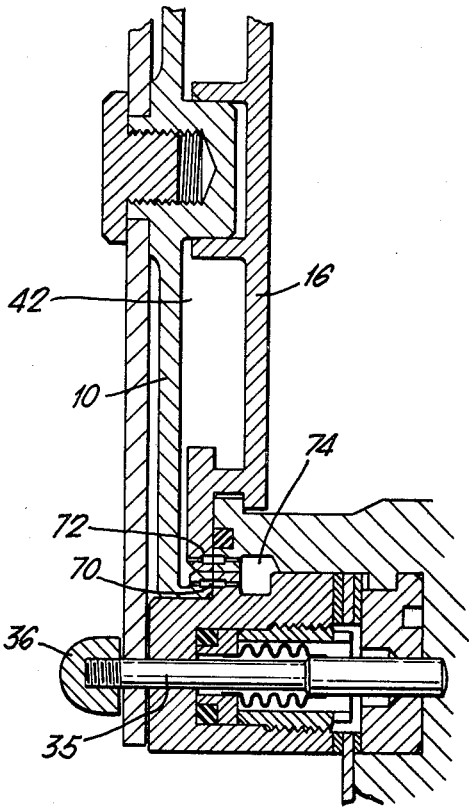
FIG. 9 is a schematic diagram of a further modification.

FIG. 9 shows a modified arrangement in which the air-stream is directed through a pair of jets 70, 72 which are radially separated and cause the surface between the jets to be swept clean. As before an air supply is fed into the gap 42 between the covers 10 and 16 and a branch supply is fed to an annular peripheral channel 74 communicating with the jets 70, 72. Door interlock is represented by numerals 35, 36.

Figure 5:
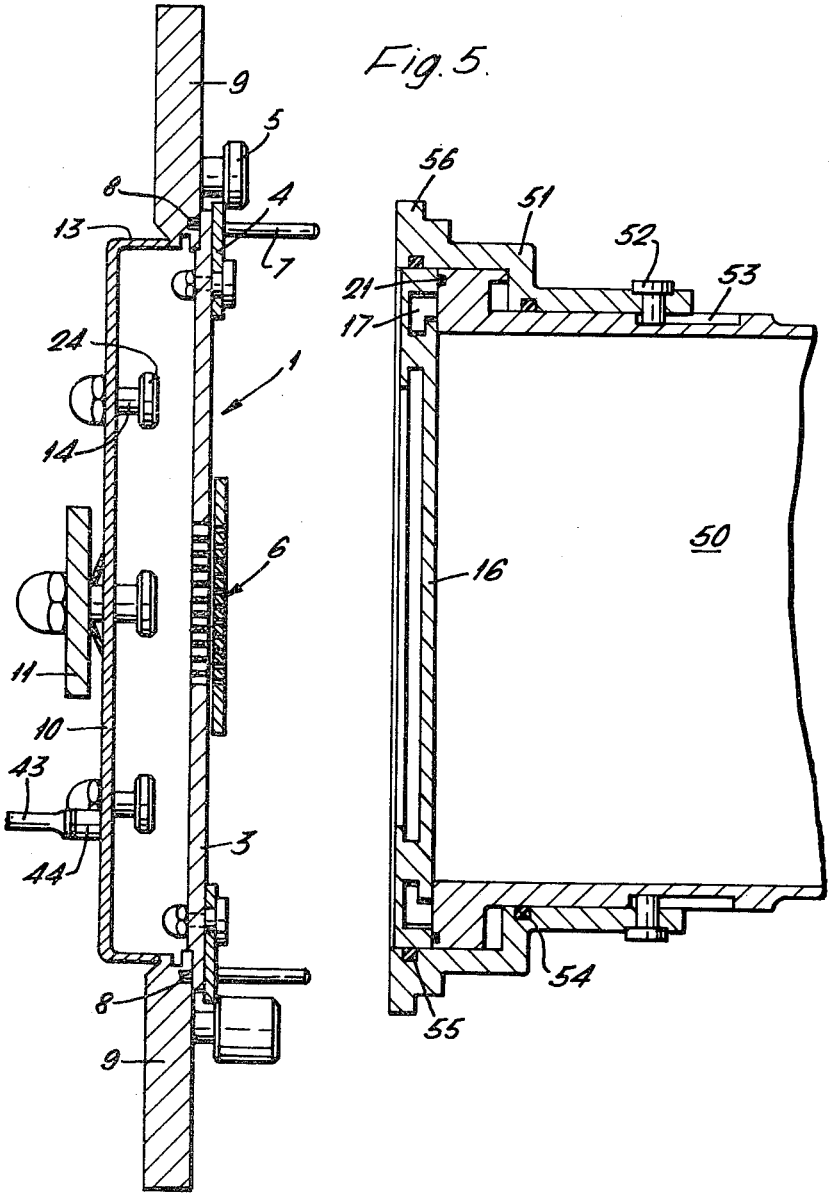
FIGS. 5 and 6 are cross-sectional views similar to FIGS. 1 and 2 of a second embodiment.
Figure 6:
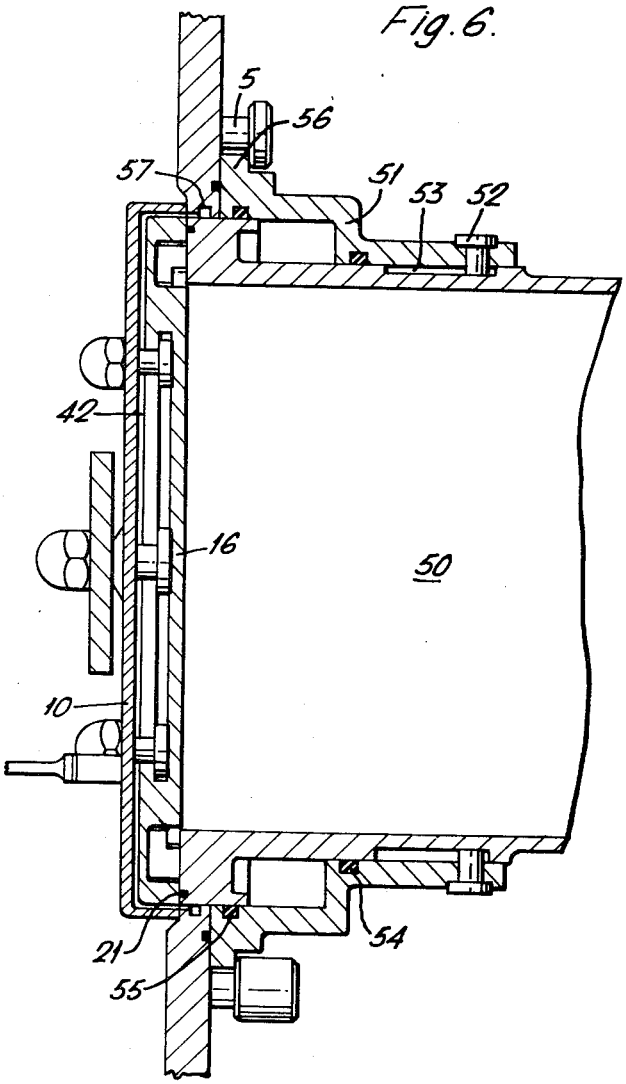

Turning now to FIG. 5 there is shown a posting port 1 in a wall 9 which is identical with that described hereinbefore with reference to FIG. 1 and identical reference numerals are used for the parts thereof. A transport container 50 having a cover which is similar to the cover 16 and is engaged with the container in a similar manner utilising projections 17. Around the open end of the container is a sleeve 51 in which the container 50 can slide. Pins 52 extend from the sleeve into grooves 53 in the wall of the container 50 to limit the extent to which the container can slide with respect to the sleeve and to ensure that the sleeve and container rotate together. A locking pin (not shown) may be present to clamp the sleeve in position relative to the container. The sleeve is provided with seals 54, 55 which contact the container 50 and container cover 16 and has an outwardly-directed flange 56 which is shaped in a similar manner to the flange 25 on the container 15 so that the flange 56 can engage with the buttons 5. This embodiment will be further described during the following description of the method of use. After removing the port cover 3 the container 50 is advanced so that the flange 56 is located on the buttons 5 and rotated so that the sleeve is engaged with the buttons 5. The container 50 is then advanced through the sleeve 51 so that the buttons 14 on the inner cover 10 enter the cut-away portions of the groove 23 on the cover 16. The container is then further rotated to engage the buttons 14 with the groove 23 to interengage the inner cover 10 with the container cover 16 and to release the container cover 16 from the projections 17 on the container. This is the position illustrated in FIG. 6. After the sleeve has been engaged with the buttons a gas stream is directed into the space 42 between the inner cover 10 and container cover 16 and to an annular gap 57 between the wall 9 and the outer wall of the container in its advanced position in a similar manner to that described above with reference to FIG. 4. The interlocks to prevent misuse and the method of transferring materials into or out of the enclosure are as described hereinbefore. When the inner cover 10 is open so that the container 50 is in communication with the enclosure 2 the surfaces of the container which may become contaminated and which might thereafter be exposed to the environment are those surfaces adjacent the seal 21. In the second embodiment described with reference to FIGS. 5 and 6 these surfaces are located between the seals 55 and 54 when the container is separated from the port thus providing further safeguards against the dispersal of toxic or radioactive materials.

I claim:

1. An apparatus for transferring toxic and radioactive materials into and out of an enclosure through a port in a wall of the enclosure comprising a container for the materials adapted to be releasably fitted about the port, a removable end cover for the container, a movable cover for the port releasably engageable with the end cover when the container is fitted to the enclosure to allow communication through the port between the enclosure and the container, and gas supply means for supplying gas at a pressure greater than the pressure within the enclosure to at least a gap between the interengaged covers to thereby prevent the ingress of toxic and radioactive material on to facing surfaces of the interengaged covers, which surfaces are exposed to the environment when the container and its cover are removed from the port.

2. An apparatus according to claim 1 in which the gas supply means further communicates with a peripheral channel about the port.

3. An apparatus according to claim 2 in which a gas inlet is located in the wall of the enclosure, a first branch path communicates with the cover for the port and a second branch path communicates with the channel in the wall of the port.

4. An apparatus according to claim 3 in which a gas outlet from said channel comprises a pair of radially separated jets.

5. An apparatus according to claim 4 in which a sleeve is slidable on the container, sealing rings on the sleeve are engageable with the container and positioned such that surfaces liable to contamination are between the seals when the container is moved away from the enclosure.

* * * * *